US005417230A

United States Patent [19]

Wood

[11] Patent Number: 5,417,230

[45] Date of Patent: May 23, 1995

[54] HAIR STYLING TOOLS AND METHODS FOR THEIR USE

[75] Inventor: Dorothy L. Wood, Bedford, Tex.

[73] Assignee: Lee Innovations, Inc., Colleyville, Tex.

[21] Appl. No.: 151,401

[22] Filed: Nov. 12, 1993

[51] Int. Cl.[6] ..... A45D 7/02

[52] U.S. Cl. ..... 132/212; 119/83; 66/117

[58] Field of Search ..... 132/212; 119/801, 808, 119/83; 66/1 A, 4, 117, 118; 223/99, 105

[56] References Cited

U.S. PATENT DOCUMENTS

| | | | |
|---|---|---|---|
| 1,146,934 | 7/1915 | Gleeson . | |
| 1,241,337 | 9/1917 | Brieitenstein . | |
| 1,548,246 | 8/1925 | Bennett . | |
| 1,790,611 | 1/1931 | Vitoux | 66/117 |
| 1,892,262 | 12/1932 | Andrew . | |
| 2,245,515 | 6/1941 | Williams | D28/39 |
| 2,357,871 | 9/1944 | Bolinger . | |
| 2,586,733 | 2/1952 | Sologaistoa | 66/117 |
| 5,036,870 | 8/1991 | Edmark . | |
| 5,167,245 | 12/1992 | Harriett . | |

FOREIGN PATENT DOCUMENTS

| | | | |
|---|---|---|---|
| 729390 | 5/1955 | United Kingdom | 132/212 |

*Primary Examiner*—John G. Weiss
*Attorney, Agent, or Firm*—Winstead Sechrest & Minick

[57] ABSTRACT

A hair styling tool 10 is described for creating a band of hair that can be incorporated into a variety of attractive hair styles. A preferred embodiment of hair styling tool 10 includes an internal shaft, that shaft terminating at one end in a knob and at the other end in a U-shaped hook, and an encasement that surrounds the central portion of the internal shaft while allowing limited movement of the internal shaft. A method for using the described hair styling tool is also disclosed.

21 Claims, 3 Drawing Sheets

HAIR STYLING TOOLS AND METHODS FOR THEIR USE

TECHNICAL FIELD OF THE INVENTION

This invention relates in general to hair styling tools and methods of their use. This invention is particularly related to a hair styling tool used for creating hair styles using one's own hair in conjunction with a rubber band, or similar apparatus for binding hair. The present invention further includes the method of using the described tool to create attractive hair styles.

BACKGROUND OF THE INVENTION

Hair care and styling is an integral aspect of a person's appearance and personal hygiene. Thus, a person's selection of their hair style has a direct effect on a person's self esteem, social and professional status. Hair styles have been utilized by almost every culture throughout history as a way to add variety and creativity to an individual's appearance. Today there exists a large, competitive international market for hair styling tools and hair accessories used to create different hair styles.

Accordingly, a need exists for an economical tool to provide a quick and convenient method of creating attractive hair styles.

SUMMARY OF THE INVENTION

The present invention fulfills the need discussed above by disclosing a hair styling tool that provides an economical means of creating attractive hair styles. The disclosed hair styling tool can be used to form a variety of hair styles quickly and easily.

In accordance with one aspect of the present invention, a hair styling tool is provided for creating hair styles using one's own hair in conjunction with a rubber band, or similar apparatus for binding hair. The disclosed tool is comprised of an internal shaft and an encasement that surrounds the central section of that shaft. The central section of the internal shaft connects a first and a second end of the shaft. The first end of the shaft terminates in a knob and the second end of the shaft has a U-shaped hook with a tip. The encasement defines an enclosure, extending from the top end to the bottom end of the encasement, adapted to slidably contain the central section of the shaft. In addition, the top end of the encasement may have an opening therethrough adapted to receive the tip of the U-shaped hook, while the bottom end of the encasement has been adapted to exclude the knob on the first end of the shaft. The tool is constructed such that the internal shaft can slidably travel up and down within the encasement. The movement of the shaft is limited in one direction by the knob and in the other direction by the U-shaped hook.

In accordance with another aspect of the present invention, a method for using the aforementioned hair styling tool is described. The described method teaches a person to thread a predetermined amount of hair through a hair tying implement, such as an elastic band, to create a variety of attractive hair styles. The described methods include the following steps: tying a hair tail with a hair tying implement; inserting the top end of the hair styling tool, with its U-shaped hook in a down position, through the hair tying implement that binds the hair tail; pushing the knob toward the bottom end of the encasement until the tip of the U-shaped hook is exposed; winding a fraction of the hair tail around the hair tying implement and the hair styling tool; threading an unwound portion of the fraction of the hair tail wound around the hair tying implement into the exposed hook; pulling the knob away from the encasement until the hook holds the threaded fraction of hair against the top end of the encasement; pulling the tool with the threaded hair fraction through the hair tying implement; and releasing the threaded hair fraction from the hook.

The foregoing has outlined rather broadly the features of the present invention in order that the detailed description of the invention that follows may be better understood. Additional features of the invention will be described hereinafter which form the subject of the appended claims.

BRIEF DESCRIPTION OF THE DRAWINGS

For a more complete understanding of the present invention, and the advantages thereof, reference is now made to the following Detailed Description of the Invention taken in conjunction with the accompanying drawings, in which:

FIG. 2A shows a two-dimensional side view of the internal shaft that forms an element of the hair styling tool of an embodiment of the present invention shown in FIG. 1;

FIG. 2B show a two-dimensional representation of the interior of one of two sides of the encasement that forms an element of the hair styling tool of an embodiment of the present invention in FIG. 1;

FIG. 2C shows a two-dimensional representation of the exterior of one of two sides of the encasement that forms an element of the hair styling tool of an embodiment of the present invention in FIG. 1;

DETAILED DESCRIPTION OF THE INVENTION

An economical hair styling tool and a quick and convenient method for its use in creating attractive hair styles are described below.

Figure 1:
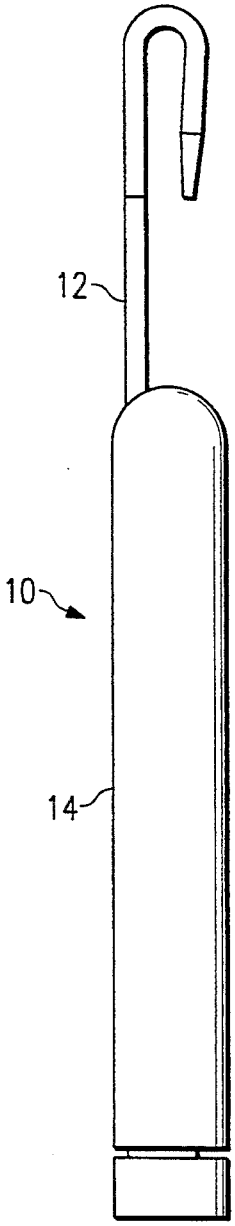
FIG. 1 shows a two dimensional side view of a preferred embodiment of the hair styling tool of the present invention in which the U-shaped hook is in an open position.
Figure 2A:
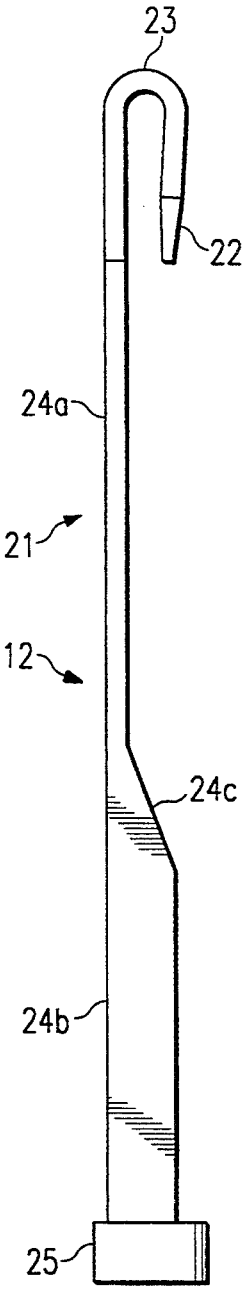
FIGS. 2A–C show the component parts of a disassembled hair styling tool as follows.

FIG. 1 shows a two-dimensional representation of a preferred embodiment of hair styling tool 10. Hair styling tool 10 is comprised of an internal shaft 12 enclosed in encasement 14. Shaft 12, illustrated in FIG. 2A, includes a central section 21 that adjoins and connects a first and second end of the shaft, the first end terminating in a knob 25 and the second end having a U-shaped hook 23 that terminates in a tip 22. The central section 21 may vary along its length in size and shape as seen in FIG. 2A. The embodiment illustrated in FIG. 2A has an upper portion 24*a* of central section 21 that adjoins the U-shaped hook 23 that is more cylindrical and narrower than the lower portion 24*b* of central section 21. The lower portion 24*b* has a wider, more rectangular and flattened appearance where lower portion 24*b* is connected to knob 25. The central section 21 of internal shaft 12 is surrounded by encasement 14 and can move up and down within an interior enclosure in encasement 14 as described below.

Figure 2B:
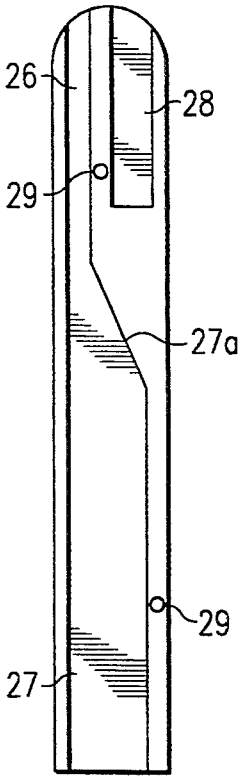
Figure 2C:
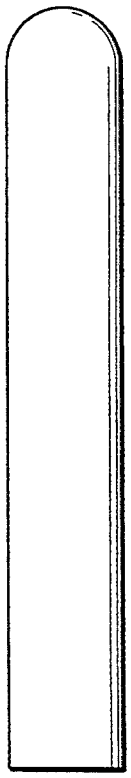

Encasement 14, in one embodiment, is composed of two halves, illustrated in FIGS. 2B and 2C. Each half has an inner surface and an outer surface. The inner surface of the first half is shown in FIG. 2B and the outer surface of the second half is shown in FIG. 2C. The outside of the two halves are identical, whereas the inner surfaces of the two halves are mirror images of each other. The inner surface of each half of encasement 14 has a pattern of indentations that are dimensioned to interface with particular portions of shaft 12. For example, in the embodiment illustrated in FIGS. 1–3 indentation 26 is dimensioned to interface with upper portion 24*a* of central section 21. Indentation 27 is dimensioned to interface with any portion of central section 21, that is the flattened lower portion 24*b* or the upper more circular section 24*a*. Indentation 28 is adapted to receive tip 22 of shaft 12. The pattern of indentations on the inner surfaces of the two halves are made to form specific enclosures, or cavities, whenever the inner surfaces of the two halves are mounted face to face. The specific enclosures described interface with shaft 12 such that shaft 12 can slidably move up and down within encasement 14 but cannot significantly rotate either clockwise or counter clockwise within encasement 14.

Figure 3:
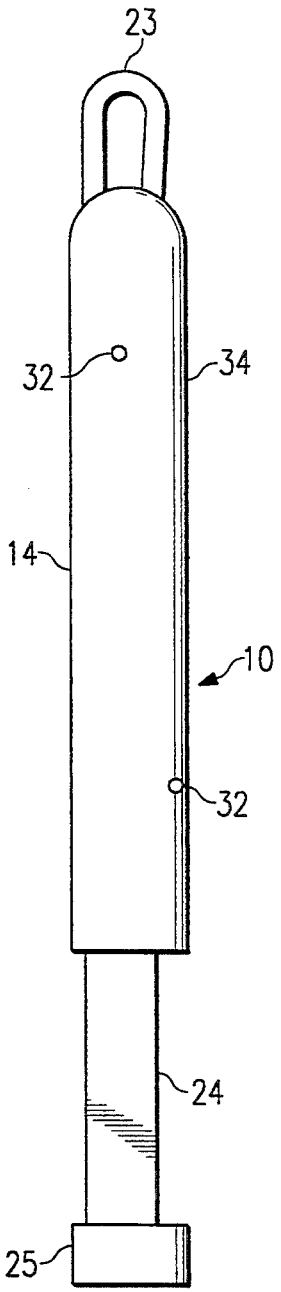
FIG. 3 shows a second representation of the embodiment of the hair styling tool of the present invention shown in FIG. 1 in which the U-shaped hook is in a closed position.

When the two halves of encasement 14 are joined the indentations formed on the inner surfaces of the two halves are aligned to form specific enclosures, or cavities, adapted to interact with the different sections of shaft 12. The resulting internal cavities of encasement 14 allow shaft 12 to slide up and down within encasement 14. The movement of shaft 12 in the upward direction is limited by the interaction of the top edge 24*c* of bottom portion 24*b* with the top portion 27*a* of indentation 27 and by knob 25 which is too large to enter the enclosure in encasement 14 created by the alignment of indentations 27 in the two halves of encasement 14. The movement of shaft 12 in the downward direction is limited by the interaction of the inner edge of U-shaped hook 23 with the top edge of encasement 14. As shaft 12 moves downward point 22 is received by an opening in encasement 14 created by the alignment of indentions 28 in the two halves of encasement 14 and central section 21 is enclosed by the cavities created by the alignment of indentions 26 and 27 of the two halves of encasement 14. Hair styling tool 10 is illustrated in FIG. 3 where shaft 12 has been pulled down such that point 22 can be seen to have entered the opening formed in encasement 14 by the interaction of indentions 28 in the two halves of encasement 14.

Hair styling tool 10 may be constructed by placing two sides of encasement 14 around shaft 12 and joining the two sides. The two sides may be permanently joined along their exterior edges by welding or gluing, or the two sides may be joined by other methods such as riveting or spot gluing them together (as represented by circles 29 in FIG. 2B) or by using a combination of joining methods. Alternatively, the two sides may be constructed such that the two halves have interlocking parts (as represented by circles 32 in FIG. 3). In this case, the two halves can be joined by connecting their interlocking parts whenever hair styling tool 10 is in use and can be disassembled for cleaning when hair styling tool is not in use. A preferred embodiment of the present invention has holes in the inner surface of one side of encasement 14 (such as represented by circles 29 in FIG. 2B) and pins on the inner surface of the other side of encasement 14 (such as represented by circles 32 in FIG. 3) that are aligned to interact with each other. The two sides of encasement 14 are preferably made of plastic so that once the sides are fitted together by inserting pins 32 into holes 29 the edges of the two sides of encasement 14 can be heat welded together.

Hair styling tool 10 may be constructed of a variety of materials. Shaft 12 can be made of any rigid or semi-rigid material such as metal, plastic, wood, bone, ivory, stone or a combination of materials. Similarly, encasement 14 may also be made of any rigid or semi-rigid material such as metal, plastic, wood, stone, bone, ivory or a combination of materials.

One embodiment of hair styling tool 10 is constructed of a one-piece plastic shaft and a plastic encasement made of two pieces that have been heat welded along their exterior edges. The interior shaft 12 of this embodiment can vary in length from 3 to 8 inches and is preferably about 4.6 inches. The U-shaped hook 23 ranges in length from 0.25 to 3 inches and in width from 0.1 to 1 inch, and is preferably about 0.8 inch in length and about 0.25 inch in width. Shaft 12 can have any cross-sectional shape, as for example a circular, oval, square, or rectangular cross-sectional shape. Preferably, shaft 12 has a circular cross sectional shape within the area of U-shaped hook 23 and in the upper portion 24*a* of central section 21. Shaft 12 will preferably have a square or rectangular shaped cross section in the flattened lower portion 24*a* of central section 21. Pull knob 25 may vary in size and shape, but knob 25 should be constructed so that it is too large to enter the opening 27 in encasement 14. Knob 25 may be made of the same material as encasement 14 or shaft 12, or it may be made of a different material than either encasement 12 or shaft 12.

Encasement 14 of the embodiment described above can vary in length from 2 to 6 inches, in width from 0.2 to 2 inches, and in thickness from 0.07 to 0.5 inches; preferable dimensions for the described embodiment are about 3.75 inches long, 0.5 inches wide, and about 0.17 inches thick. Encasement 14 may be oval, rectangular, or a combination of shapes.

The design of hair styling tool 10 will vary in size and shape depending on a customer's personal preference and on the tool's use. Hair styling tool 10 can be used to create attractive hair styles for men, women, and children. However, hair styling tool 10 may also be used to style the hair of dolls, wigs, mannequins used in department store floor and window displays, or for animal grooming. For example, hair styling tool 10 can provide a convenient and quick way to style a horse's mane or the coat of a long haired dog. The size, shape, composite materials and design of hair styling tool 10 may vary significantly with the various applications of hair styling tool 10.

Figure 4:
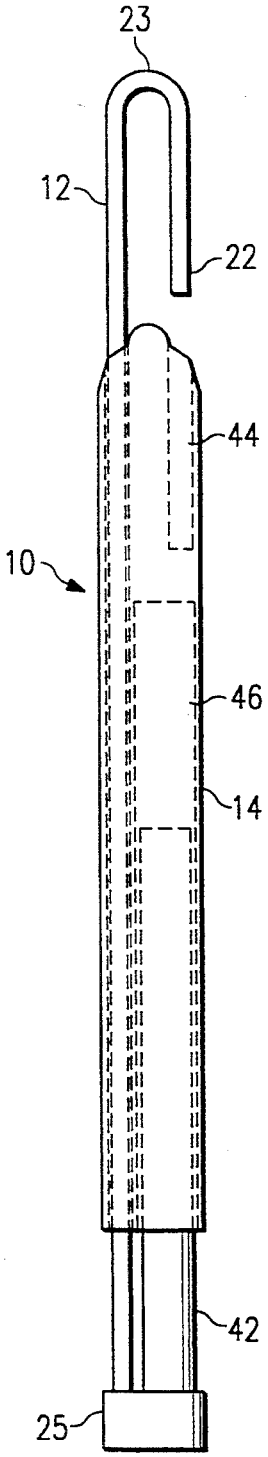
FIG. 4 shows a two-dimensional representation of an alternative embodiment of the present invention.
Figure 5:
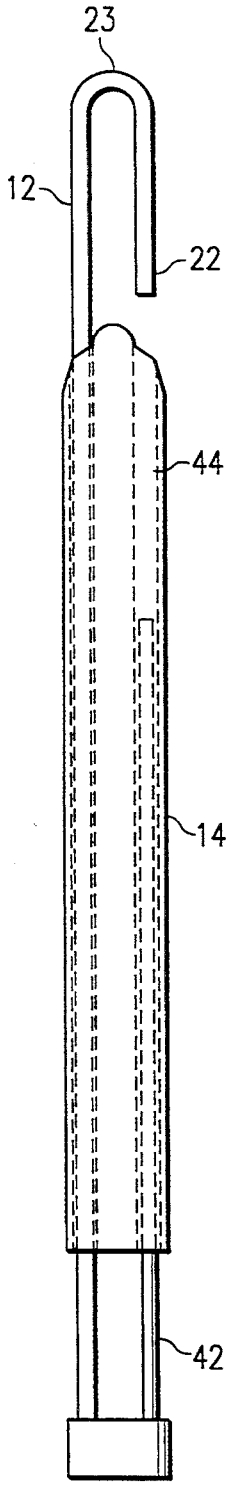
FIG. 5 shows a two-dimensional representation of an alternative embodiment of the present invention.

FIGS. 4–5 show alternative embodiments of hair styling tool 10 where encasement 14 is a single piece and shaft 12 is about the same size and shape along its length from the U-shaped hook 23 to where it is connected to a knob 25. The embodiments illustrated in FIGS. 4–5 comprise a shaft 12 with a U-shaped hook at one end and, in contrast to the embodiment illustrated in FIG. 1, knob 25 is separate from and joined to shaft 12 at the opposite end of shaft 12 from the U-shaped hook 23. Furthermore, the embodiments shown in FIGS. 4–5 have an aligning structure 42 that may either be joined to knob 25 or constructed as an extension of knob 25.

The embodiments of FIGS. 4–5 are constructed by taking encasement 14 (a single piece) and threading the non-hooked end of shaft 12 through a cavity in encasement 14 made to receive shaft 12. When shaft 12 has been threaded through encasement 14 the non-hook end is joined to knob 25, which has previously been joined to alignment structure 42. Alignment structure 42 prevents the rotation of shaft 12 within encasement 14 such that tip 22 will enter opening 44 when shaft 12 is pulled downward. The alignment structure 42 may vary in size and shape and can either be a separate piece attached to knob 25 or can be an extension of knob 25. Alignment structure 42 is adapted to fit a cavity 46 in encasement 14. If alignment structure 42 is the same size and shape as tip 22 then opening 44 may be extended through the entire length of encasement 14 such that alignment structure 42 will fit into the bottom side of opening 44 (as seen in FIG. 5).

Figure 6:
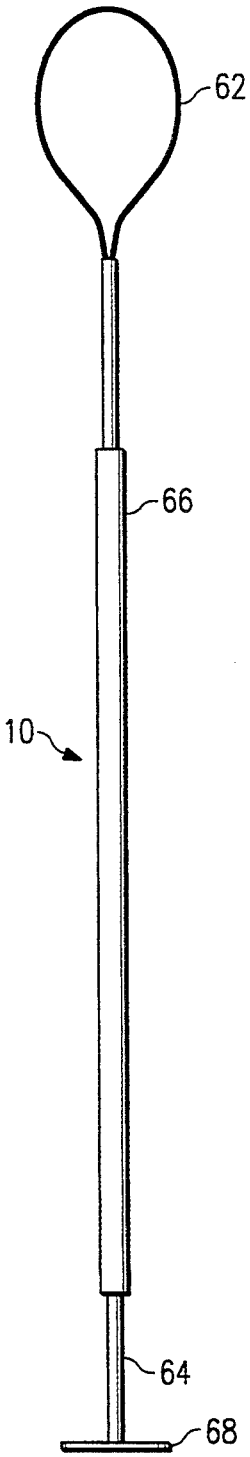
FIG. 6 shows a two-dimensional representation of an alternative embodiment of the present invention.
Figure 7:
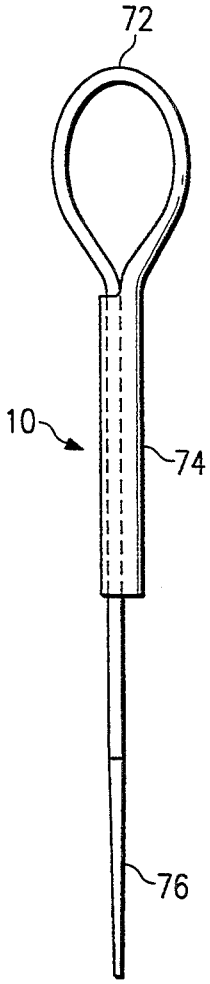
FIG. 7 shows a two-dimensional representation of an alternative embodiment of the present invention.

Additional embodiments of hair styling tool 10 are shown in FIGS. 6–7. FIG. 6 shows an embodiment of hair styling tool 10 comprising a loop 62, an inner shaft 64 with an attached pull knob 68, and an outer shaft 66. The inner shaft 64 and outer shaft 66 are preferably made of a relatively inflexible material such as a metal, plastic,stone, ivory, bone, or wood. On one end of inner shaft 64 is attached a flexible loop 62, loop 62 may vary in size and is preferably constructed of monofilament line. On the opposite end of inner shaft 64 is attached a pull knob 68. Pull knob 68 can be made of any material and is secured to inner shaft 64 to prevent outer shaft 66 from inadvertently sliding off the bottom of inner shaft 64. In lieu of a pull knob 68, the bottom of inner shaft 64 may be deformed sufficiently to prevent outer shaft 66 from sliding off the bottom of inner shaft 64. The embodiment of hair styling tool 10 shown in FIG. 6 may vary in length, size and shape. The example shown in FIG. 6 has cylindrical inner and outer shafts. The inner shaft 64 varies from four to twelve inches in length and from 0.02 to 0.5 inches in diameter. Inner shaft 64 may be either hollow or solid. The outer shaft 66 may be either shorter or longer than inner shaft 64. However, outer shaft 66 must be hollow and slightly larger in diameter than inner shaft 64, such that outer shaft 66 can fit over inner shaft 64 and slide up and down inner shaft 64. Outer shaft 66 will constrict the size of loop 62 whenever it is slid over inner shaft 64 in an upward direction, or away from pull knob 68.

FIG. 7 illustrates another embodiment of hair styling tool 10. The embodiment illustrated in FIG. 7 comprises a loop 72, a pointed probe 76, and a sliding shaft 74. Loop 72 is made of a flexible material, such as a rope or cord. Loop 72 is permanently attached at one end to sliding shaft 74. The other end of loop 72 is attached to probe 76. Probe 76 is made of a relatively inflexible material such as metal, plastic, wood, bone, ivory, stone, or a combination of materials and may vary substantially in size and shape. Sliding shaft 74 may be constructed any of a number of shapes and sizes. Sliding shaft 74 may be composed of a variety of materials such as cord, rope, plastic, wood, metal, stone, ivory, or a combination of materials. Sliding shaft 74 has a hollow core that encloses the two sides of loop 72. Loop 72 is made smaller by pulling down on probe 76 and is made larger by moving sliding shaft 74 closer to probe 76.

Figure 8A:
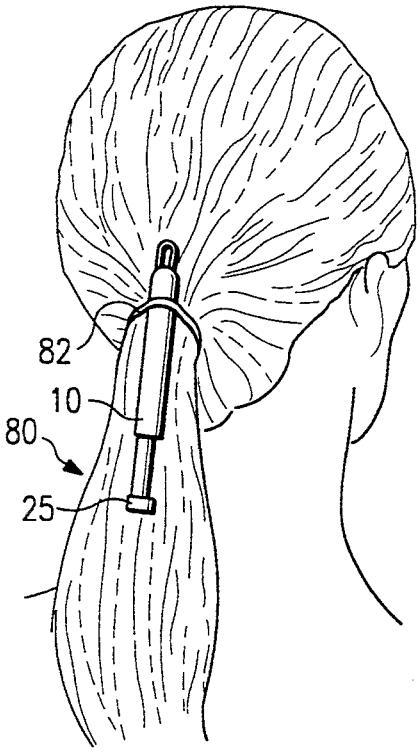
FIGS. 8A–D illustrate a method of use for the hair styling tool of the present invention.
Figure 8B:
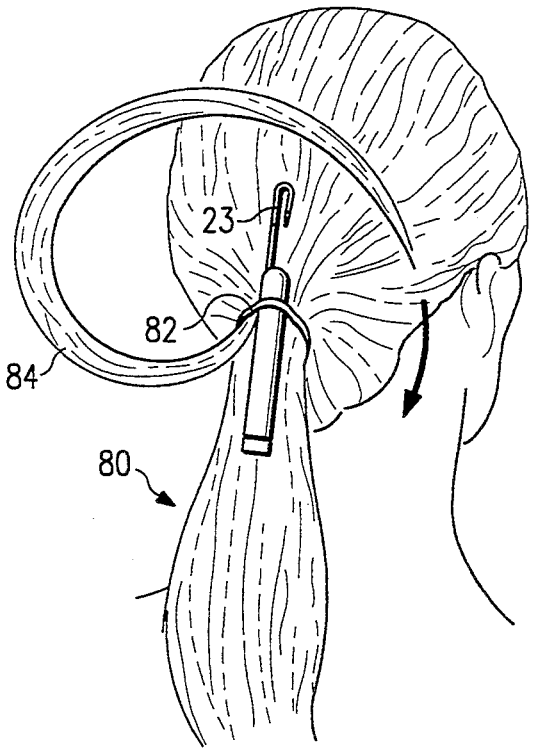
Figure 8C:
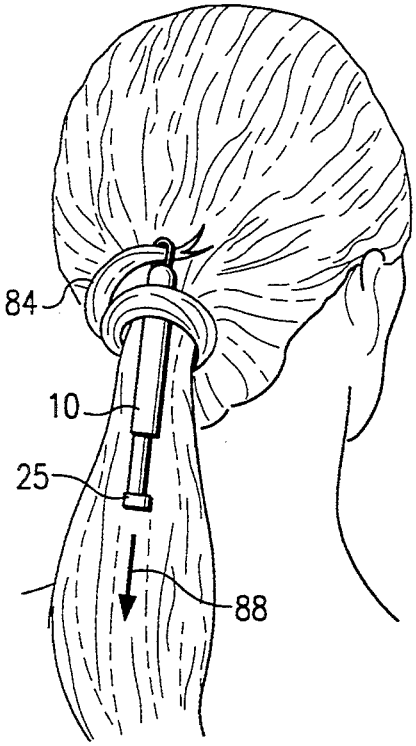
Figure 8D:
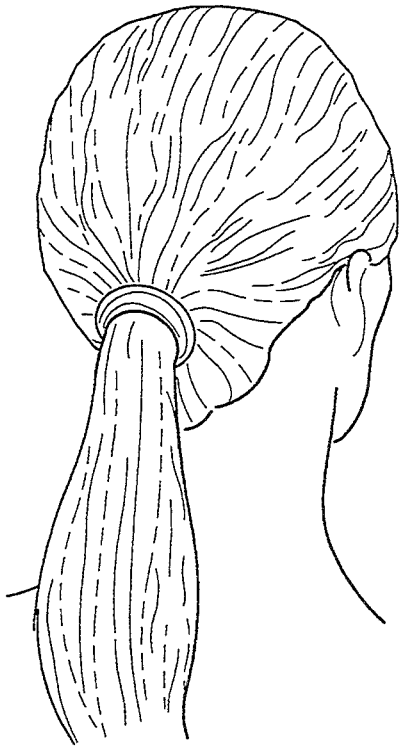

Referring now to FIGS. 8A–D, a method of using hair styling tool 10 (the embodiment shown in FIG. 1) is illustrated in a step-by-step manner. A hair tail 80, such as a ponytail, is made using a hair tying implement 82, such as an elastic band. The top side of hair styling tool 10 is inserted through the hair tying implement 82 that binds hair tail 80 as shown in FIG. 8A. Hair styling tool 10 is in a closed position with knob 25 in the down position, as shown in FIG. 3, while being inserted through hair tying implement 82. Once the top of encasement 14 and U-shaped hook 23 are on the opposite side of hair tying implement 82 from knob 25, knob 25 is pushed up so that the U-shaped hook 23 is exposed or open as shown in FIG. 8B. Hair strand 84 (a fraction of the hair making up hair tail 80) is then wrapped or wound several times around hair styling tool 10 and hair tying implement 82. Hair strand 84 is wound, starting at the bottom of hair tying implement 82 and continuing upward, preferably in the direction of the open U-shaped hook 23 (as shown in FIGS. 8B–C). When hair strand 84 has sufficiently covered implement 82 to achieve the desired effect, the remainder of strand 84 is placed within the opening of U-shaped hook 23. Holding strand 84 in place with one hand, pull knob 25 is pulled down with the other hand until hook 23 is snug around hair strand 84. Hair styling tool 10 is then slowly and carefully pulled down through hair tying implement 82 in the direction of arrow 88 in FIG. 8C. Once the hair styling tool 10 has pulled the unwound portion of hair strand 84 through the hair tying implement 82, hair strand 84 is released from the U-shaped hook 23 by pushing knob 25 upward.

The embodiments of hair styling tool 10 shown in FIGS. 6 and 7 are used in a similar fashion as described above. However once hair strand 84 has been wound around implement 82 to achieve the desired effect, the remainder of strand 84 is threaded through the flexible loop (loop 62 in FIG. 6 and loop 72 in FIG. 7). Pull knob 68 or probe 76, respectively, is then pulled down to tighten the loop around hair strand 84 to hold the hair in place while the hair styling tool 10 is drawn through implement 82.

The employment of hair styling tool 10 as described will result in an attractive band of natural hair wrapped around hair tying implement 82. While FIG. 8 illustrates creating a natural hair band in conjunction with a ponytail, similar hair bands can be used to add variety and beauty to a number of hair styles. For example, natural hair bands can also be used to create distinctive pigtails, doggy ears, multiple strand ponytails, mock french braids, and other hair styles.

While preferred embodiments of the invention have been shown and described, it will be apparent to those skilled in the art that the conception of the specific embodiments described may be readily utilized as a basis for modifying or designing other hair styling tools for carrying out the same purpose as the present invention. It should also be realized by those skilled in the art that such equivalent constructions do not depart from the spirit and scope of the invention as set forth in the appended claims.

What is claimed is:

1. A hair styling tool, comprising:

an internal shaft, said shaft having a central section, a first end and a second end, said central section connecting said first and second ends, said first end coupled to a knob and said second end including a U-shaped hook, said hook extending outwardly from said central section and terminating in a tip;

an encasement defining an enclosure, said enclosure extending from a top end to a bottom end of said encasement and slidably containing said central section of said shaft, wherein said shaft can move in two directions within said enclosure, said movement limited in one direction by said knob and in a second direction by said hook.

2. The tool as set forth in claim 1, said top end further comprising an opening therethrough adapted to receive said tip.

3. The tool as set forth in claim 1 wherein said enclosure is smaller than said knob.

4. The tool as set forth in claim 1 wherein said shaft comprises a material selected from the group consisting of plastic, metal, bone, ivory, stone, and wood.

5. The tool as set forth in claim 1 wherein said shaft comprises plastic.

6. The tool as set forth in claim 1, wherein said shaft is a one-piece construction.

7. The tool as set forth in claim 1 wherein said central section is wider where said section adjoins said first end than where said section adjoins said second end.

8. The tool as set forth in claim 1 wherein said knob is comprised of a different material than said shaft.

9. The tool as set forth in claim 1 wherein said tip is pointed.

10. The tool as set forth in claim 1 wherein said shaft is longer than said encasement.

11. The tool as set forth in claim 1 wherein said knob is connected to an aligning structure.

12. The tool as set forth in claim 11 wherein said knob is joined to said first end with an epoxy resin.

13. The tool as set forth in claim 1 wherein said encasement is comprised of a material selected from the group consisting of plastic, metal, bone, ivory, stone, or wood.

14. The tool as set forth in claim 1 wherein said encasement comprises plastic.

15. The tool as set forth in claim 1 wherein said encasement is comprised of a plurality of pieces.

16. The tool as set forth in claim 15 further comprising a joining means for connecting said pieces.

17. The tool as set forth in claim 16 wherein said joining means comprises welding the pieces together.

18. The tool as set forth in claim 16 wherein said joining means comprises gluing the pieces together.

19. The tool as set forth in claim 1 wherein said encasement comprises more than one material.

20. The tool as set forth in claim 11 wherein said encasement further comprises an opening adapted to receive said alignment structure.

21. A method for threading a predetermined amount of hair through a hair tying implement using a hair styling tool comprising an internal shaft and an encasement, the internal shaft having a first end terminating in a knob, and a second end including a U-shaped hook, the hook extending outward from the center section of the internal shaft and terminating in a tip, the encasement defining an enclosure extending from a top end of the encasement to a bottom end of the encasement, and adapted to slidably contain the internal shaft, the top end of the encasement including an opening adapted to receive the tip and the bottom end of the encasement adapted to exclude the knob, the method comprising the steps of:

tying a hair tail with a hair tying implement;

inserting said top end of said encasement through said hair tying implement;

opening said U-shaped hook by pushing said knob toward said bottom end of said encasement;

winding a fraction of said hair tail around said hair tying implement and said tool;

threading an unwound portion of said fraction into said hook;

pulling said knob away from said encasement until said hook holds said threaded fraction against said top end of said encasement;

pulling said tool with said threaded fraction through said hair tying implement; and releasing said threaded fraction from said hook.

* * * * *